United States Patent [19]

Johnson et al.

[11] 4,177,860

[45] Dec. 11, 1979

[54] HEATING AND COOLING THERMOSTAT WITH CHANGEOVER SWITCHING OPERATED UPON CONTROL POINT ADJUSTMENT

[75] Inventors: Vern C. Johnson, Minneapolis; Virgil K. McCormick, Wayzata; John M. Whitney, Bloomington, all of Minn.

[73] Assignee: Honeywell Inc., Minneapolis, Minn.

[21] Appl. No.: 878,053

[22] Filed: Feb. 15, 1978

Related U.S. Application Data

[63] Continuation of Ser. No. 712,119, Aug. 5, 1976, abandoned.

[51] Int. Cl.[2] ..... F25B 29/00; H01H 37/52; H01H 37/12

[52] U.S. Cl. ..... 165/26; 236/1 C; 337/340; 337/360

[58] Field of Search ..... 236/1 C, 68 B; 165/26, 165/27; 337/337, 340, 360, 374

[56] References Cited

U.S. PATENT DOCUMENTS

| | | | |
|---|---|---|---|
| 2,403,798 | 7/1946 | Holmes | 165/26 |
| 2,729,719 | 1/1956 | Kronmiller | 200/138 |

*Primary Examiner*—William E. Wayner
*Attorney, Agent, or Firm*—Clyde C. Blinn; Henry L. Hanson

[57] ABSTRACT

A thermostat adapted for controlling heating and cooling apparatuses has a temperature control point adjustment means connected to a changeover switch means whereby upon the adjustment of the temperature control point adjustment means in a first range to select a cooling control point, the changeover switch means only connects the thermostat to the cooling apparatus and when the temperature control point adjustment means is in the heating range, the changeover switch means only connects the thermostat to the heating apparatus. The limited range of temperature selection in the first and second range is an energy conservation feature of the thermostat.

14 Claims, 8 Drawing Figures

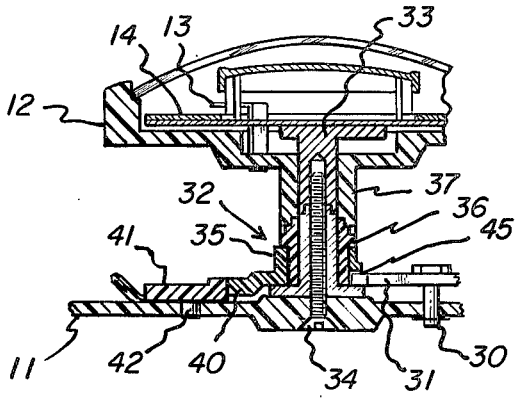
FIG. 4
FIG. 5
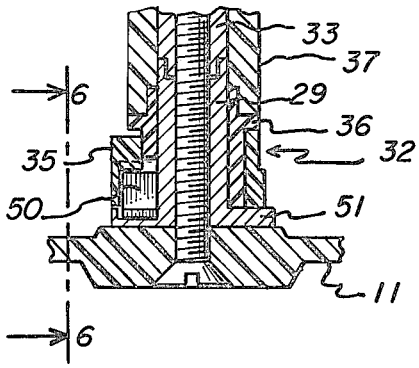
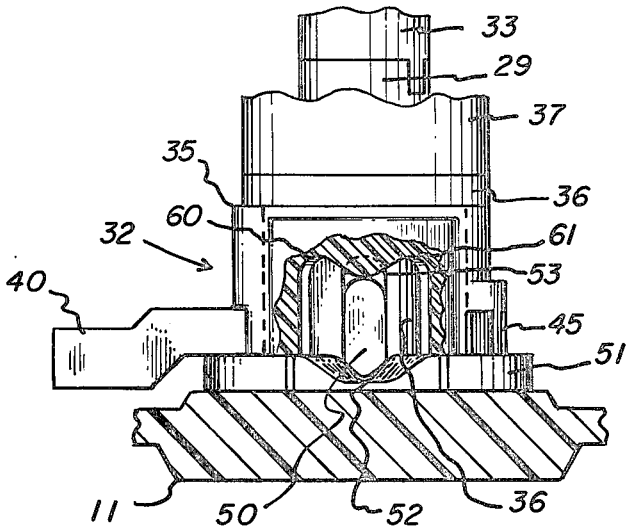
FIG. 6
FIG. 7
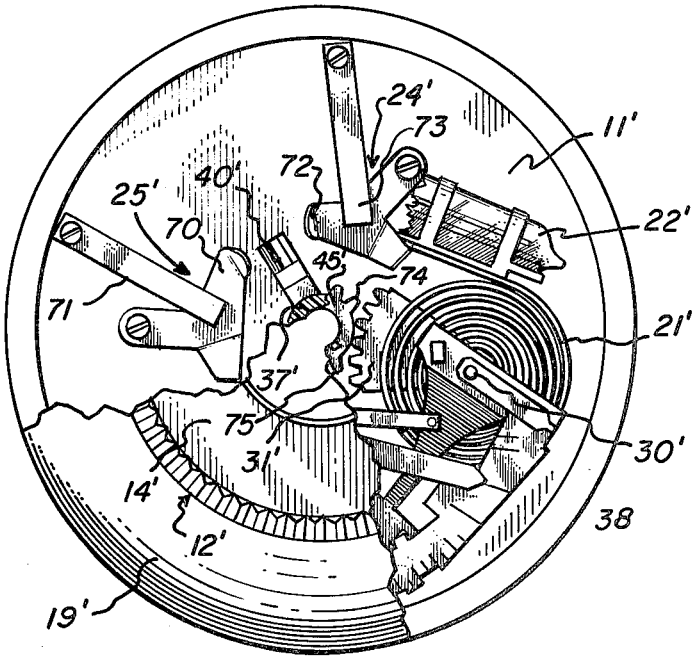
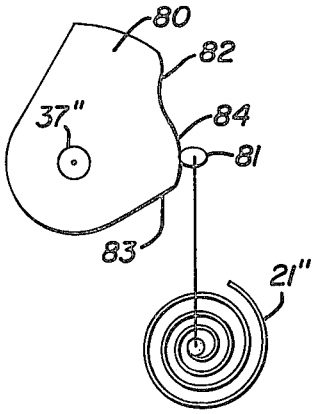
FIG. 8

HEATING AND COOLING THERMOSTAT WITH CHANGEOVER SWITCHING OPERATED UPON CONTROL POINT ADJUSTMENT

This is a continuation of application Ser. No. 712,119, filed Aug. 5, 1976, now abandoned.

BACKGROUND AND SUMMARY OF THE INVENTION

For a number of years, a single wall thermostat has been available for controlling both heating and cooling apparatus supplying either heated or cooled air to a space in which the thermostat is mounted. Such a thermostat might have a single temperature responsive means for operating a switch for both cooling and heating as shown in the Walter E. Edelman et al U.S. Pat. RE. No. 28,676, reissued Jan. 13, 1976, wherein a subbase contains switches for selectively providing the changeover operation to connect the thermostat to control either heating apparatus or cooling apparatus. Other types of thermostats contain separate temperature responsive switch means each controlling heating apparatus or cooling apparatus to provide automatic changeover between the heating and cooling operation such as shown in the Elmer A. Carlson U.S. Pat. No. 2,978,228, issued Apr. 4, 1961. In these thermostats an almost unlimited range of control point adjustment is provided.

Prior art thermostats have had various ways, such as adjustable stops as shown in the Carl G. Kronmiller U.S. Pat. No. 2,729,719, issued Jan. 3, 1966, of limiting the temperature adjustment to some energy conserving level both in the heating and cooling operation. With the advent of a more recognized need to conserve energy, the need for even more sophisticated limiting means for a thermostat setting control point adjustment is recognized.

The present invention provides a thermostat for use for controlling heating and cooling apparatus wherein a control point adjustment in either the heating or cooling range is limited to conserve energy. Furthermore, the thermostat provides for the changeover from heating to cooling operation by means of a less expensive changeover switch apparatus to eliminate the previously used subbase, therefore, a thermostat is available at a lower cost to the consumer. Specifically, the thermostat has a control point adjustment knob which can be adjusted in a cooling range of temperatures or a heating range of temperatures, each of the ranges are limited to provide temperatures for the conservation of energy. The control point adjustment knob is connected to a changeover switch in the thermostat; so that, upon a movement of the control point adjustment knobs from the cooling range to the heating range, the changeover switch is operated. The operation of heating or cooling apparatus when the control point adjustment knob is in the cooling or heating range, respectively, is prevented.

The embodiments of the present invention are shown in the figures of which

Figure 1:
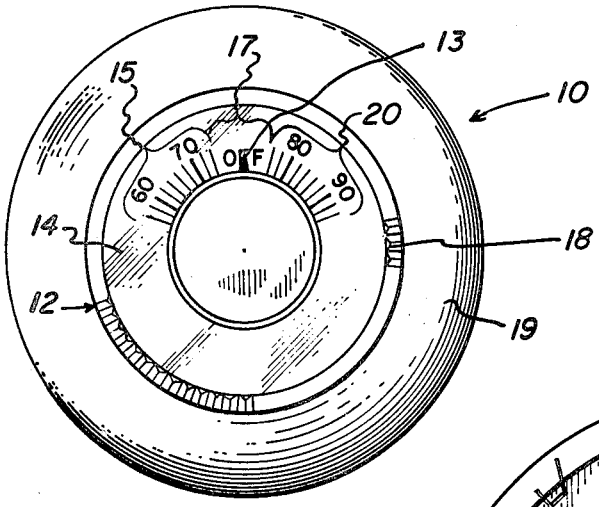
Figure 3:
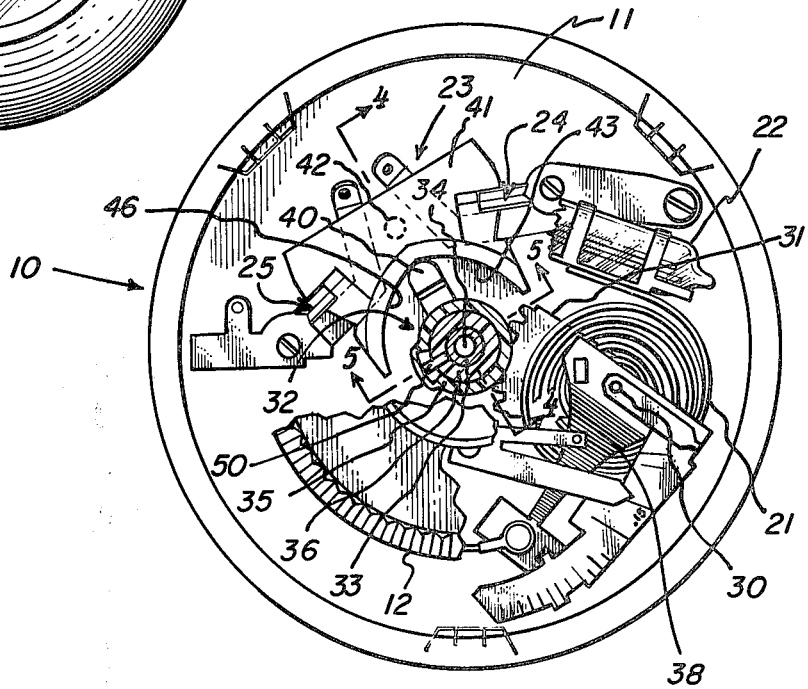
Figure 2:
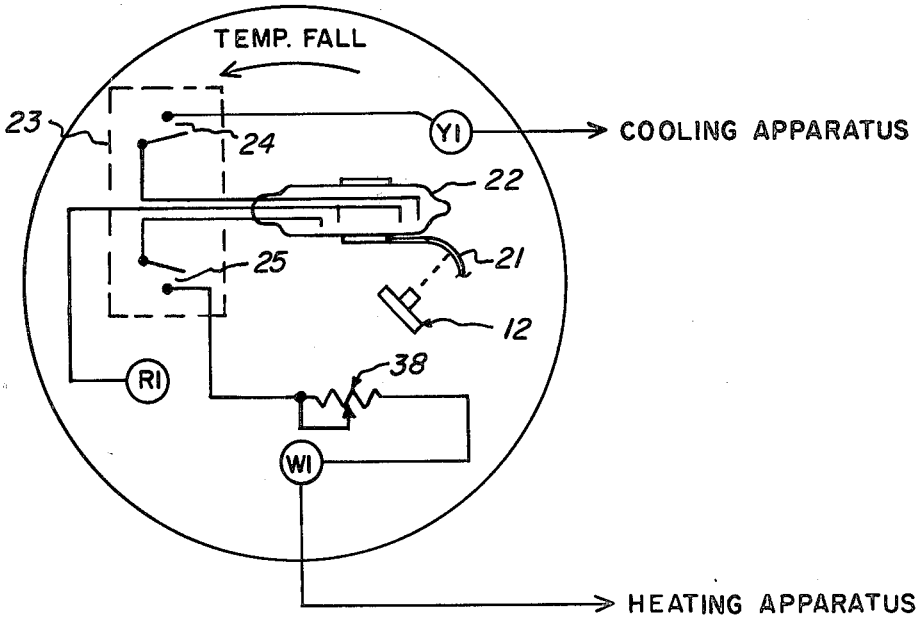

FIG. 1 is a front view of the thermostat showing a typical temperature scale with the two control point adjustment ranges separated by the off position, and FIG. 2 is a schematic diagram of one typical electrical connection of the thermostat, FIG. 3 is a cutaway view of the thermostat of FIG. 1, showing the bimetal operated switch and the changeover switch, FIG. 4 is a cutaway view of the center shaft of the thermostat as shown in FIG. 2, and FIG. 5 is an enlarged view of the center shaft of the thermostat shown in FIGS. 2 and 4, FIG. 6 is an enlarged view of a portion of the center shaft shown in FIG. 5, FIG. 7 is a second embodiment of the thermostat shown in FIG. 1, and FIG. 8 is a third embodiment of the thermostat of FIG. 1.

DESCRIPTION OF THE INVENTION

Referring to FIG. 1, the thermostat 10 has a base 11 (not shown) to which a temperature control point adjustment member or knob 12 is rotatably attached for selecting or adjusting a temperature control point by positioning a pointer or indicator 13 in a series of positions. Indicator 13 cooperates with a stationary temperature scale or index 14 having a first range 15 for selecting a heating temperature control point and a second range 20 for selecting a cooling control point. The scale or ranges 15 and 20 are separated by an intermediate or "off" range 17. Knob 12 has a serrated circumference portion 18 providing for ease of manual rotation of the temperature control point adjustment knob. A ring or cover 19 encloses the mechanism of the thermostat.

Thermostat 10 is adapted to be connected to control either cooling or heating apparatus as shown by an electrical system circuit in FIG. 2. A power source or secondary winding of a transformer (not shown) would be connected to terminal R1 and the other side of the heating and cooling control apparatus (not shown) as shown in the mentioned Edelman et al patent. The therostat has a temperature responsive element or bimetal 21 connected to control the position and thus operation of a switch 22. Switch 22 has two portions similar to that of the Walter E. Edelman et al patent for controlling either the heating apparatus or cooling apparatus depending upon the operation of a changeover switch mechanism 23. When the switch 24 is closed, the thermostat is connected to control the cooling apparatus and when switch 25 is closed, the thermostat is connected to control the heating apparatus through the circuit including a conventional heat anticipation heater 38. The adjustment of the control point of the thermostat by moving the position of bimetal 21 is accomplished by the rotation of knob 12 shown in FIG. 1. To select a heating operating temperature in the range 15 (58° to 75° F.) while switch 25 is closed and to select a cooling operating temperature in range 20 (75° to 94° F.) while switch 24 is closed. When the temperature control point adjustment member 12 is rotated so that the indicator 13 is in the "off" position 17 as shown in FIG. 1, neither switch 25 nor 24 of FIG. 2 is closed and the heating and cooling apparatus is off. The range 15 has an upper heating temperature limit of 75° F. and range 20 has a lower cooling temperature limit of 75° F., for energy conservation. With the limited ranges, there is no need for limit stops on the temperature adjustment knob 12.

Specifically, one embodiment of the thermostat as shown in FIG. 3 has bimetal 21 mounted on a post 30 which is attached normal to the base 10 so the position of switch 22 connected to the other extremity of the bimetal is adjusted as the temperature of the bimetal changes. Post 30 and bimetal 21 are connected to a gear sector 31 which is positioned by the movement of the control point adjustment knob 12 shown in FIG. 1 through a connection and lost motion mechanism 32. Mechanism 32 as shown in FIGS. 3 and 4, comprises a support shaft 33 which is rigidly attached to scale 14 and is held normal on base 11 splined to a post and upport member 29 by a screw 34. A member or hub 37 is rotatably carried on shaft 33 and is connected to member 36 rotatably carried on shaft 29, for providing the connection to the gear sector 31 and the changeover switch operating member or lever 40 through member 35 to be described later.

The changeover switch mechanism 23, shown in FIG. 3, has a member 41 which is pivotally mounted on base 11 at pivot 42 and has associated therewith two switches 24 and 25. As lever 40 is rotated in either direction, it cooperates with the arcuate cam surfaces 43 and 46 of member 41 to cause movement of member 41 about its pivot 42 to operate one or the other of the switches 24 and 25. By a design of the intersection of cam surfaces 43 and 46, a small angle of rotation of knob 12 and movement of member 40 can take place without movement of the switch operator 41. Such provides an "off" range 17 of selected positions of the control point adjustment knob 12 in which the changeover switches 24 and 25 are in the off position. When member 40 is moved counterclockwise to engage surface 46, a pivotal force is applied to member 41 to rotate it about pivot 42 and close switch 25. Since surface 46 aligns with the arcuate movement of member 41 through range 15, member 41 will only pivot a predetermined angular amount to operate switch 25. Similarly, upon movement of member 40 clockwise to operate switch 24, the cooling apparatus is connected to switch 22.

Mechanism 32 is shown in more detail in FIGS. 4, 5 and 6. Referring to FIG. 4, knob 12 is shown rotatably supported on base 11 for movement of the changeover switch actuating lever 40 and gear sector 31 for adjusting the position of bimetal 21 through the gear sector 45 which is attached to member 37. Referring to FIG. 5, post member 29 and shaft 33 are held together on the base by screw 34 to support the scale plate 14. Rotatably connected on post 29 and shaft 33 is a key carrying driving post member or sleeve 36 which is attached to knob hub 37 or knob 12. A driven member or sleeve 35 is rotatably connected on the same axis to member 36. Member 36 carries a locking member or key 50 for interconnecting driven member 35 and driving member 36.

Referring to FIG. 6, the lower base portion or carrier 51 of post 29 has a notch 52 for receiving key 50 when the changeover switch lever 40 is in the position as shown in FIG. 3 and the changeover switch mechanism 23 is in the off position. When key 50 is in notch 52, the upper portion of the key clears the projection 53 of member 35 so that the key carrying driving member 36 is free to be rotated a small angle with control point adjustment knob 12 without moving driven member 35 and gear sector 45. A lost motion between the control point adjustment knob 12, and the gear sector 45, through the off range 17 of the thermostat is provided. Upon the movement of the key carrying member 36 by the rotation of knob 12 in either direction to the right or to the left, key 50 is lifted out of notch 52 until it is in a locking position to engage either detent or notch 60 or 61. Depending upon the direction of rotation, members 35 and 36 are locked together to rotate along with knob 12 to adjust the position of bimetal 21, through the range of rotation of the control point setting for either the cooling adjustment shown as 20 in FIG. 1, or the heating adjustment shown as 15.

In the operation of the thermostat, upon the movement of the temperature control point adjustment knob 12 from the off position as shown in FIG. 1, to select a temperature in the heating range 15, the movement of lever 40 rotates the changeover switch member 41. The heating changeover switch 25 connects the thermostat switch 22 to the heating apparatus. In any particular portion of range 15, the thermostat operates as a normal heating thermostat energizing the heating apparatus when the space temperature did not satisfy the temperature responsive bimetal 21. If the temperature control point adjustment was increased above 75° F., the changeover switch operates to open the heating switch 25 and limit the heating operation to 75° F. In the position above 75° F., lever 40 is in the position as shown in FIG. 3 and the changeover switch mechanism 23 has switches 24 and 25 in an open position. A similar operation is accomplished for cooling in the control point adjustment range 20 to limit the cooling temperature to a lower limit of 75° F.

In order to provide a range of operation of the control point adjustment knob 12 in the "off" position, between 75° F. for heating and 75° F. for cooling without changing the adjustment of the temperature control by bimetal 21, the lost motion is provided by means of locking member or key 50 of mechanism 32 which connects control point adjustment knob 12 to the gear sector 45. When the control point adjustment knob 12 reaches the off position, key 50, as shown in FIG. 6, drops into the the notch 52 and allows the knob through member 37 to continue to rotate through the off range 17 without carrying the member 35 and thus holding the gear sector 45 in a fixed position through the off position. Mechanism 32 provides a larger movement of knob 12 within the control temperature adjustment of ranges 15 and 20, so a more positive off range 17 is provided. As soon as the control point adjustment knob 12 is moved into cooling range 20, shown in FIG. 1, key 50 as shown in FIG. 6, moves upward to engage notch 60 and lock the mechanism 32 to provide for a normal adjustment of the position of bimetal 21 through the cooling range of the control point adjustment knob 12.

DESCRIPTION OF SECOND EMBODIMENT

Referring to FIG. 7, the second embodiment of the invention is shown having a base 11' to which a temperature responsive member or bimetal 21' is attached by a shaft 30' to be adjusted by the position of a gear sector 31' to determine the control point setting of the thermostat and thus the operation of switch 22'. The control point adjusting knob 12' is attached to the rotating shaft 37' which carries the gear sector 45' and the changeover switch operating lever 40'. Upon the rotation of the control point adjustment knob 12' from the off position as shown, to either the cooling operating range or the heating operating range, member 40' is moved to the left or right to operate either the cooling changeover switch 24' or the heating changeover switch 25'. Switches 24' and 25' are made up of resilient members which can be moved together to form the switches. As the switch member 40' moves to the left to engage resilient member 70 and lift the member away from the base to engage member 71 and heating changeover switch 25' is closed. Similarly, when member 40' moves to the right to engage resilient member 72 to lift the member away from the base to engage member 73, the cooling changeover switch 24' is closed.

To provide the lost motion for movement of the control point adjusting knob 12 in the off range 17 intermediate the heating and cooling ranges as shown in FIG. 1, gear sector 45' has a greater space between two adjacent teeth 74 and 75. An angle of rotation of shaft 37' by knob 12 can exist without any movement of the gear sector 31' until either tooth 74 engages the gear sector 31' or tooth 75 engages the gear sector 31' in one or the other direction. No change in the position of bimetal 21' takes place when knob 12' is moved in the "off" range 17.

The operation of the second embodiment is similar to that of the main embodiment in that upon an adjustment of the control point of the thermostat by rotation of knob 12', the position of the gear sector 31' and thus the temperature setting of bimetal 21' is selected. Depending upon which way the control point adjustment member is rotated, switch member 40' closes either of the system changeover switches 24' or 25' to provide for operation of the thermostat in either the limited heating or limited cooling range.

DESCRIPTION OF THIRD EMBODIMENT

A third embodiment of the invention, shown in FIG. 8, has a conventional cam 80 which is connected to control point adjustment knob 12 by connection 37. A cam rider 81 is connected to adjust the position of the bimetal 21 and thus the control point temperature of switch 22. The cam 80 has a changing radius so the cam rider has a predetermined movement or portions 82 and 83 of the cam as knob 12 is adjusted in ranges 15 and 20. A flat portion 84 on the cam intermediate the portions associated with ranges 15 and 20 provides the "lost motion" mechanism to have no adjustment of the bimetal by control point adjustment knob 12 in the "off" range 17. Switches 24 and 25 are controlled by separate cam riders (not shown) engaging the surface of the cam to operate for the system changeover operation.

The embodiments of the invention in which an exclusive property or right is claimed are defined as follows:

1. In a thermostat adapted for controlling heating and cooling apparatus to maintain a predetermined temperature in a space, comprising, a base member, space temperature responsive switch means attached to said base member, first switch means on said base member adapted to connect said temperature responsive switch means to control the heating apparatus, second switch means on said base member adapted to connect said temperature responsive switch to control the cooling apparatus, single member temperature control point adjustment means mounted on said base member having a first and a second range of temperature adjustments, first mechanical means connecting said single adjustment means to said temperature responsive switch to select a predetermined control temperature to be maintained in the space when said adjustment means is in either said first or said second range of temperature adjustments, and further mechanical means connecting said single adjustment means to said first switch means whereby said space temperature responsive switch means is adapted to control the heating apparatus to maintain a predetermined space temperature of said first range when said single adjustment means is in said first range of temperature adjustments, said further mechanical means connecting said single adjustment means to said second switch means whereby said space temperature responsive switch means is adapted to control the cooling apparatus to maintain a predetermined space temperature of said second range when said single adjustment means is in said second range of temperature adjustments.

2. The invention of claim 1 comprising, a temperature scale mounted on said base adjacent said single member temperature control point adjustment means, said scale having a first temperature marked portion usable with said control point adjustment means when said adjustment means is moved in said first range (for heating operation) and a second temperature marked portion usable with said control point adjustment means when said adjustment means is moved in said second range for cooling operation.

3. The invention of claim 2 wherein said first switch means opens said control circuit of the heating apparatus at a 75° F. marking on said temperature scale associated with heating thereby the control point temperature of said temperature responsive switch means for said first range for heating is limited to a maximum of 75° F. for energy conservation, and said second switch means opens said control circuit of the cooling apparatus at a 75° F. marking on said temperature scale associated with cooling thereby the control point temperature of said temperature responsive switch means for said second range for cooling is limited to a minimum of 75° F. for energy conservation.

4. In a thermostat adapted for controlling heating and cooling apparatus to maintain a predetermined temperature in a space, comprising, a base member, space temperature responsive switch means attached to said base member, first switch means on said base member adapted to connect said temperature responsive switch means to control the heating apparatus, second switch means on said base member adapted to connect said temperature responsive switch to control the cooling apparatus, single member temperature control point adjustment means mounted on said base member having a first and a second range of temperature adjustments, connection means connecting said single adjustment means to said temperature responsive switch means to select a predetermined control temperature to be maintained in the space when said adjustment means is in either said first or said second range of temperature adjustments, further means connecting said single adjustment means to said first switch means whereby said space temperature responsive switch means is adapted to control the heating apparatus to maintain a predetermined space temperature of said first range when said single adjustment means is in said first range of temperature adjustments, and still further means connecting said single adjustment means to said second switch means whereby said space temperature responsive switch means is adapted to control the cooling apparatus to maintain a predetermined space temperature of said second range when said single adjustment means is in said second range of temperature adjustments, said connection means having a lost motion means operable when said control point adjustment means is moved in a third range between said first and second range so that said control point adjustment means has no effect on the temperature adjustment of said temperature responsive switch means when said control point adjustment means in in an intermediate range.

5. The invention of claim 4 wherein said first and second switch means are open when said control point adjustment means is in said third range whereby neither the heating apparatus nor the cooling apparatus is adapted to operate, and said first and second ranges are limited to temperature ranges for energy conservation.

6. The invention of claim 4 wherein said temperature scale has a blank portion between said first portion and second portion which is a portion in which both said first and said second switches are ineffective to operate either heating or cooling apparatuses.

7. The invention of claim 4 wherein, said connection means is a cam means connected to said temperature control point adjustment means and a cam rider means connected to said temperature responsive switch means, and said lost motion means is a flat portion on said cam means to have no adjustment of said temperature responsive switch means when said temperature control point adjustment means is moved between said first and second range.

8. A thermostat apparatus adapted for controlling heating apparatus and cooling apparatus, comprising, temperature responsive control means responsive to space temperature, temperature control point adjustment means having a first series of positions for selecting a heating temperature and a second series of positions for selecting cooling temperature, connection means connecting said control point adjustment means to said temperature control means to adjust the control temperature said temperature responsive control means maintains in the space, changeover switch means adapted to selectively connect said temperature responsive control means to control the operation of either the heating appartus or the cooling apparatus, and connection means connecting said temperature control point adjustment means to said changeover switch means so that when said control point adjustment means is in said first series of positions, said changeover switch means is adapted to connect the heating apparatus to said temperature responsive control means to control the temperature in the space at a selected heating temperature and when said control point adjustment means is in said second series of positions said changeover switch means is adapted to connect the cooling apparatus to said temperature responsive control means to control the temperature in the space at a selected cooling temperature.

9. The invention of claim 8 wherein said temperature control point adjustment means has a temperature scale having a first portion cooperating with said first series of positions for selecting a heating temperature and a second portion cooperating with said second series of positions for selecting a cooling temperature, and said changeover switch means is adapted to prevent operation of said cooling apparatus when said control point adjustment means is set on said first portion of the scale and to prevent operation of said heating apparatus when said control point adjustment means is set on said second portion of the scale.

10. The invention of claim 9 wherein said scale has a third portion between said first and second portions, and said changeover switch means is adapted to disconnect the heating and the cooling apparatus from said temperature control means when said control point adjustment means is in between said first and second series of positions.

11. The invention of claim 10 wherein said third portion of said scale is labeled "off" and neither the heating apparatus nor the cooling apparatus is energized.

12. A thermostat comprising a base adapted to be mounted on a vertical wall in a space wherein the temperature is to be controlled for either cooling or heating, a first rotatable post member mounted normal to said base for supporting a bimetal to which a temperature control switch means is attached, a second rotatable temperature adjusting post member mounted normal to said base adjacent said first post member, drive means connecting said first and second post members so that upon the rotation of said second post member to a selected position, the position of said first post member is adjusted to determine the control temperature of said switch means, changeover switch means adapted to selectively connect said temperature control switch means to control the operation of heating apparatus and cooling apparatus, connection means connecting said second post to said changeover switch means to that when said second post member is in a first range of selected positions said changeover switch means is adapted to connect said temperature control switch means to control the heating apparatus and when said second post member is in a second range of selected positions said changeover switch means is adapted to connect said temperature control switch means to control the cooling apparatus.

13. The invention of claim 12 wherein said drive means connecting said first and second post members has a lost motion means to provide for a third range of selected positions of said second post member in between said first and second range of selected positions so that upon rotational movement of said second post member in said third range no change in the position of said first post member takes place to adjust the control temperature of said temperature control switch means, and said changeover switch means has an off position when said second post is in said third range of positions whereby neither the heating apparatus or the cooling apparatus is energized.

14. The invention of claim 13 wherein said drive means comprising a first gear sector attached to said first post member, a second gear sector attached to said second post member, said first and second gear sectors engaging to provide relative movement of said post members, one of said gear sectors having a greater spacing between two adjacent teeth to provide said lost motion means.

* * * * *